United States Patent [19]

Kurdziel

[11] 4,183,177

[45] Jan. 15, 1980

[54] AUTOMOBILE DOOR OPENING APPARATUS

[76] Inventor: George R. Kurdziel, 286 Red Oak, Williamsville, N.Y. 14221

[21] Appl. No.: 880,435

[22] Filed: Feb. 23, 1978

[51] Int. Cl.[2] ..... E05F 15/20

[52] U.S. Cl. ..... 49/25; 49/276; 49/279; 49/302; 49/357

[58] Field of Search ..... 49/25, 26, 276, 279, 49/281, 357, 302, 336.3; 292/DIG. 4; 16/DIG. 7; 180/113

[56] References Cited

U.S. PATENT DOCUMENTS

| | | | |
|---|---|---|---|
| 2,094,413 | 9/1937 | Schonitzer | 49/276 X |
| 2,665,153 | 1/1954 | Teichmann | 49/25 X |

*Primary Examiner*—Kenneth Downey
*Attorney, Agent, or Firm*—Allen J. Jaffe

[57] ABSTRACT

A remote controlled automobile door opening system having solenoid assemblies for unlocking, unlatching and partially opening the automobile door in response to a remote radio signal. The unlocking, unlatching and partial opening of the door occur sequentially after the radio signal is received.

15 Claims, 4 Drawing Figures

AUTOMOBILE DOOR OPENING APPARATUS

BACKGROUND OF THE INVENTION

The present invention relates to automobile safety devices and, more particularly, to such a device which functions primarily to unlock and slightly open the driver's door in response to a signal remote from the vehicle.

In many situations or circumstances it becomes extremely important that an automobile door can be unlocked and partly opened so that an approaching driver or occupant can enter the vehicle as quickly as is possible. In fact in darkly lighted streets, parking lots or garages where potential muggers, robbers or rapists may be lying in wait, permitting a potential victim to quickly enter the vehicle, without any delay (such as fumbling for keys or placing packages down), may avoid bodily harm or even death.

Presently known remote car door unlocking and/or car door opening devices are known, as typified by U.S. Pat. Nos. 2,787,461; 3,002,581; 3,160,408; 3,858,922; and 3,893,260. However, these prior patents do not disclose nor suggest a system for remote actuation wherein the actuating signal is generated from a point outside of the vehicle proper, thus cannot actually or inherently accomplish the safety or security aspects of the present invention.

Moreover, the systems of the prior art whether electrical, mechanical or electro-mechanical are relatively complex, costly and generally require significant modifications of existing automobile door latching or locking structure.

SUMMARY OF THE INVENTION

The foregoing disadvantages, as well as others, of the prior art are overcome according to the teachings of the present invention which provides a remote control system for unlocking, unlatching or otherwise actuating automobile components from a point exteriorly from the vehicle.

More specifically the present invention relates to a remote control system, and the component parts thereof, which permits an individual to unlock or unlatch a car door from a location outside the car body whereby the door is slightly ajar to permit speedy access to the interior of the vehicle.

In addition to the remote actuation of the car door, the present invention contemplates, according to one aspect thereof, remote actuation of other vehicle components such as lights, horn and truck lid as will become apparent hereinbelow.

Basically, then, the present invention provides an automobile security system comprising a wheeled vehicle having at least one door for permitting ingress and egress to and from the interior thereof, locking and latching means on said door cooperating with a member fixed to the body or frame of the vehicle for securing said door in a locked and latched position, means on said door located on the interior side thereof for normally actuating said locking and latching means, auxiliary means affixed to said vehicle for sequentially actuating said locking and latching means first from a locked position to an unlocked position and then from a latched position to an unlatched position, means for generating a control signal remote from and exteriorly of said vehicle, control means fixed to said vehicle for actuating said auxiliary means in response to said control signal, and means fixed to only one of said door and body actuable by said auxiliary means to exert a force on said car door sufficient to partially ajar the same when said door is in said unlatched position thereby permitting rapid entry to the interior of said vehicle.

BRIEF DESCRIPTION OF THE DRAWINGS

For a fuller understanding of the present invention reference should now be had to the following detailed description thereof taken in conjunction with the accompanying drawings wherein.

DESCRIPTION OF THE PREFERRED EMBODIMENTS

Figure 1:
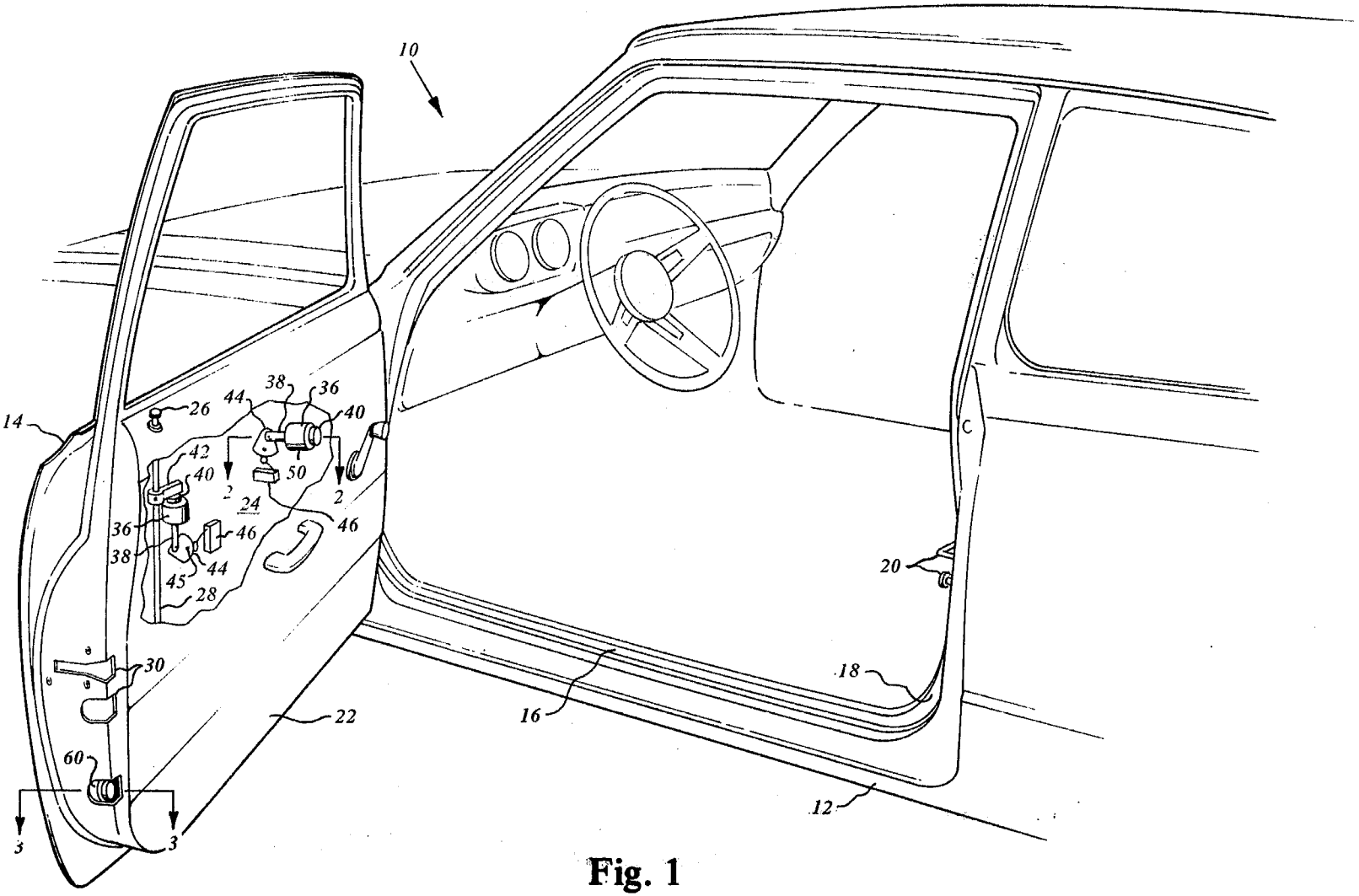
FIG. 1 is a fragmentary pictorial view of an automobile illustrating schematically the salient features of the present invention.

Referring now to the drawings and, more particularly, to FIG. 1 an automotive vehicle is depicted generally at 10 as comprising a body 12, a door 14 hinged to the body for pivotal movement with respect thereto, a door opening on the body having a threshold 16 and a vertical post 18 extending therefrom remote from the door hinges (not illustrated) and a locking and latching member 20 immovably fixed to the post, as is conventional.

An interior door panel 22 is removably attached to the door 14 and defines a cavity 24 therebetween, and has mounted thereon an interior locking and unlocking button 26 affixed to a suitable recipricating linkage 28 within the cavity which provides the conventional door locking and unlocking functions by way of its conventional attachment to the door locking and latching mechanism located at opening 30. Inasmuch as these locks and latches are conventional components of all automotive vehicles (although the design thereof may vary from manufacturer to manufacturer), no further description or illustration is deemed necessary.

Figure 2:
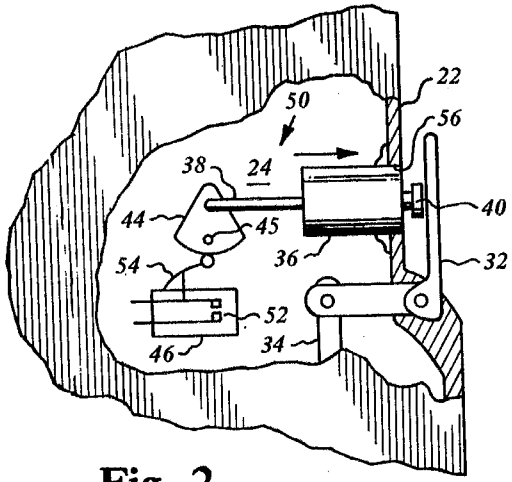
FIG. 2 is a schematic fragmentary sectional view taken along line 2—2 of FIG. 1.

An interior door handle, depicted schematically at 32 in FIG. 2 is supported by the panel 22 and is pivotally mounting for actuating a linkage or cable 34 which may be directly or indirectly connected to the locking and/or latching mechanism at 30, depending upon the conventional design of the particular vehicle to which the present invention is installed. However, for purposes of continued description it will be assumed that linkage or cable 34 functions only to causing unlatching of the door after it has been previously unlocked.

Turning now to the mechanical components of the present invention and their structural coaction with the thus far described conventional automobile components, auxiliary means are provided for sequentially unlocking and unlatching the conventional locking and latching structure without affecting or interfering with the normal operation thereof.

It is assumed illustratively that the vehicle shown in FIG. 1 is of the type wherein once locked the door can only be unlocked from the vehicle interior by actuation of the lock button 26. To this end auxiliary unlocking and unlatching means are illustrated as separate components. It is to be understood, of course, if the vehicle were of the type wherein the inside door handle functions to unlock as well as unlatch, then the auxiliary unlocking and unlatching means can be a single component.

Referring to FIG. 1 the unlocking component of the auxiliary unlocking and unlatching means, depicted generally at 35, comprises a solenoid 36 having a reciprocating thrust plunger 38 normally biased in its retracted position. Plunger 38 at one end has a head 40 for contacting a projecting lever 42 which is fixed for reciprocation with the lock button linkage 28. At its other end the plunger 38 has affixed thereto a cam actuator 44, rotatably mounted about axis 45, for a micro switch 46, as will be disclosed in greater detail hereinbelow. The arrangement is such that when solenoid 36 is actuated plunger head 40 is thrust from the solenoid core against lever 42 causes shaft 28 to reciprocate upward to unlock the car door. At the end of its stroke the plunger causes cam 44 to rotate about its axis for closing micro switch 46. The solenoid-cam-micro switch assembly may be conveniently located in door cavity 24 and may be suitably mounted to one of the door panel 22 or to the frame of the door 14.

A similar solenoid-cam-micro switch assembly is proved at 50 for acting upon the interior door handle 32 to perform the unlatching function of the auxiliary unlocking and unlatching means. Inasmuch as this assembly is the same as that previously described similar numerals are employed to depict the details thereof. Thus when solenoid 36 is actuated plunger 40 is thrust inward toward the vehicle interior and contacts and moves door handle 32 in a door unlatching direction. When the door is unlatched at the end of the plunger's stroke the normally open contacts 52 of micro switch 46 are closed by movement of a cantilever spring 54 fixed to one contact under the action of cam 44 rotating about its axis 45. The assembly 50 may be conveniently located adjacent handle 32 as by locating and supporting the same through an opening 56 in the door panel 22.

Means for imparting a force relative to the door 14 and the post 18 are provided in the form of a third solenoid-cam-microswitch assembly at 60 (FIGS. 1 and 3), which is similar to those previously described. Solenoid 36 may be conveniently supported within the door hollow or cavity 24 through an opening or cutaway 62 in door panel 22.

Figure 4:
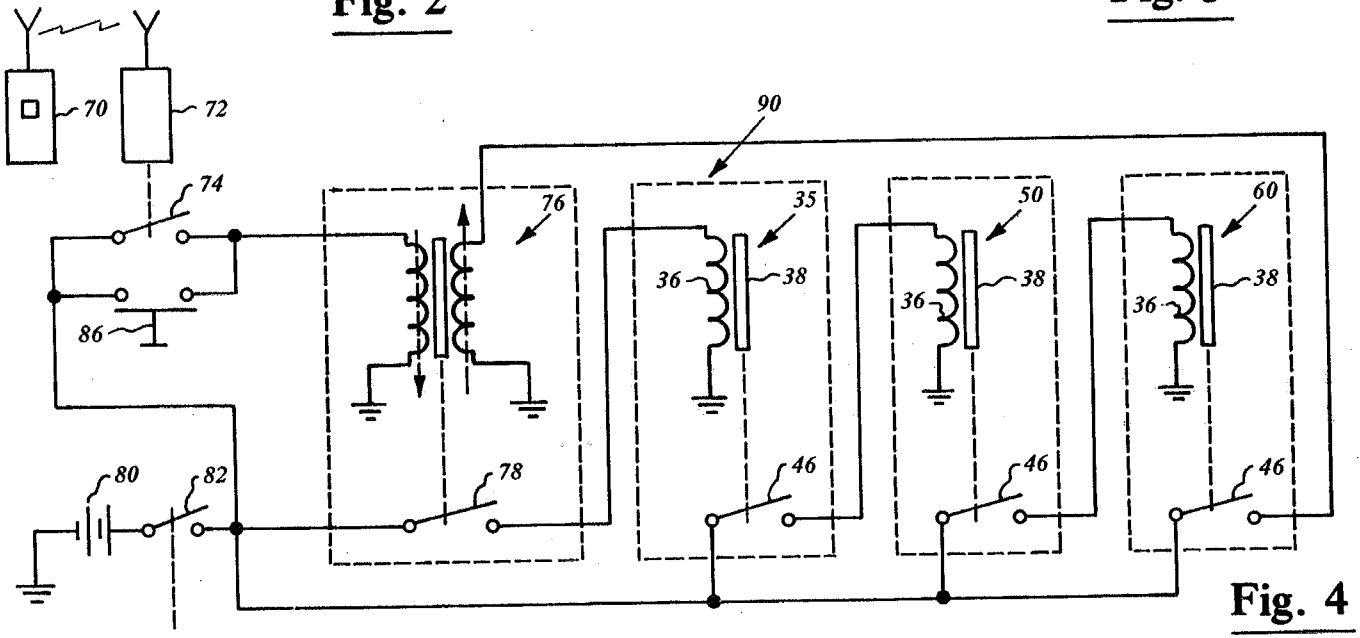
FIG. 4 is a schematic circuit diagram of the electrical controls of the present invention.

The operation of the present invention will now be discussed together with a description of the circuit diagram of FIG. 4. A conventional hand-held radio wave transmitter 70, which may be similar to those employed in automatic garage door openers, is activated by momentarily closing a push-button operated switch to emit a signal of a preselected frequency. A conventional receiver 72, which may be affixed to any convenient non-interferring portion of the automobile body, functions in response to the preselected frequency signal to momentarily close a switch 74, shown schematically as mechanical but could also be electronic. The momentary closure of switch 74 supplies power from the car battery 80 to energize one coil of the differential relay 76, provided a safety ignition switch 82 is closed by removal of the ignition key from the vehicle. The ignition switch thus serves to prevent operation of the present invention when the vehicle key is in the ignition circuit.

Energization of one coil of differential relay causes a snap acting switch 78 to close, and remain closed, providing power from the battery to the solenoid 36 of the unlocking component 35 causing the plunger 38 thereof to move upwardly against lever 42 (FIG. 1) forcing the unlocking of the car door through shaft 28 and the conventional unlocking structure (not illustrated). At the completion of its stroke, when the car door is unlocked, the plunger of assembly 35 causes micro-switch 46 to close through the action of cam 44.

Closure of this micro-switch permits power from the battery to be applied to the solenoid 36 of unlatching component 50 causing the plunger 38 thereof to move from the position shown in FIG. 2 to a position inwardly towards the interior of the vehicle. During such movement plunger head 40 contacts door handle 32 and forces movement thereof in a direction to unlatch the car door through the conventional unlatching linkage 34 and the conventional door locking and latching structure (not illustrated). At the completion of its stroke, when the car door is unlatched, the plunger of assembly 50 causes the micro-switch 46 to close through the action of cam 44.

Figure 3:
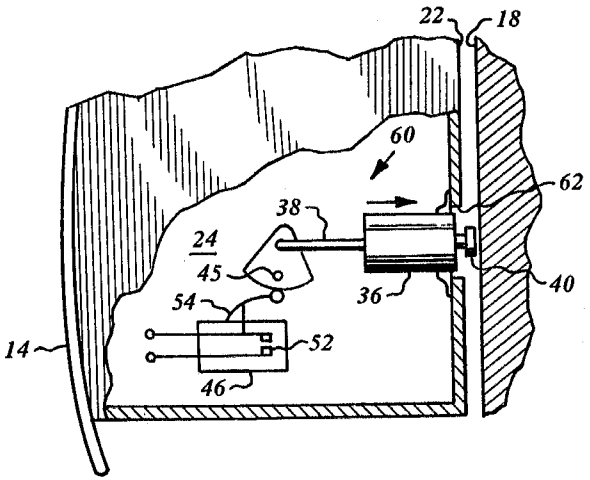
FIG. 3 is a schematic fragmentary sectional view taken along line 3—3 of FIG. 1.

Closure of this micro-switch permits power from the battery to be applied to the solenoid 36 of assembly 60 to thereby cause plunger 38 thereof to come into contact with and impact upon post 18 (FIG. 3). This action will cause door 14 to open just enough to permit quick and easy access to the interior of the vehicle. At the end of its stroke, when the car door is partially open, the plunger of assembly 60 causes the micro-switch 46 thereof to close through the action of cam 44.

Closure of this micro-switch permits battery current to be applied to the other coil of differential relay 76 to thereby open snap acting switch 78, which will remain open even after the car door is closed and micro-switch 46 of assembly 60 is again opened.

As auxiliary push-button switch 86 may be located in parallel with switch 74 in the event it is desired to operate the auxiliary door opening system from the interior of the vehicle.

As indicated earlier the present description assumes a vehicle of the type wherein the unlocking cannot be accomplished by the interior door handle linkage. However, some types of vehicles are designed to permit the interior door handle linkage to unlock as well as unlatch the door. For these types of vehicles the assembly 35 may be eliminated together with the circuitry within the dashed box 90 in FIG. 4. In this event the unlocking and unlatching function would be accomplished by the single assembly 50.

Although preferred embodiments of the present invention have been described, changes will obviously occur to those skilled in the art. For example additional solenoid-cam-micro-switch assemblies could be provided to perform other auxiliary functions such as actuating car horns, lights, trunk lids, etc. It is therefore intended that the present invention be limited only by the scope of the appended claims.

I claim:

1. An automobile door opening apparatus for a wheeled vehicle having at least one door for permitting ingress and egress to and from the interior of said vehicle, comprising;

(a) locking and latching means on said vehicle for normally locking and latching said door, (b) means on said door located interiorily of said vehicle for normally actuating said locking and latching means, (c) auxiliary means affixed to said vehicle for sequentially actuating said locking and latching means first from a locked position to an unlocked position and then from a latched position to an unlatched position, (d) means for generating a control signal remote from and exteriorly of said vehicle, (e) control means fixed to said vehicle for actuating said auxiliary means in response to said control signal, (f) opening means fixed to only one of said door and body of said vehicle actuable to exert a force on said door sufficient to at least partially open the same in response to a signal from said auxiliary means to thereby permit rapid entry to the interior of said vehicle, (g) said control means including a first switching device, (h) said auxiliary means comprises a movable member located adjacent said locking and latching means for imparting a force thereto in response to the closure of said first switching device, (i) a second switching device actuable by said movable member, and (j) said opening means comprises a second movable member located between said door and the vehicle for imparting a relative force therebetween sufficient to partially open the door in response to the closure of said second switching device.

2. The apparatus according to claim 1, wherein there is further provided;

(l) a third switching device actuable by said second movable member.

3. The apparatus according to claim 2, wherein;

(m) said control means further comprises an actuator for said first switching device responsive to said third switching device for opening said first switching device.

4. The apparatus according to claim 3, wherein;

(n) said movable members are solenoid plungers.

5. The apparatus according to claim 4, wherein;

(o) said means for generating a control signal comprises a radio transmitter, and (p) said control means includes a receiver.

6. The apparatus according to claim 1, wherein;

(l) said movable member comprises a solenoid plunger.

7. The apparatus according to claim 1, wherein;

(l) said movable members comprise solenoid plungers.

8. The apparatus according to claim 1, wherein;

(l) said movable means comprises a normally retracted solenoid plunger, and (m) said second movable member comprises a normally retracted solenoid plunger.

9. The apparatus according to claim 1, wherein;

(l) said means for generating a control signal comprises a transmitter, and (m) said control means comprises a receiver.

10. The apparatus according to claim 9, further comprising;

(n) a differential relay having two cores, (o) a switch actuable by one of said cores to a closed position, and (p) said one core is energized by said control means.

11. The apparatus according to claim 10, further comprising;

(q) a switch actuated by said solenoid plunger of said opening means, and (r) said other core is energized by closure of said last mentioned switch.

12. An Automobile door opening apparatus for a wheeled vehicle having at least one door for permitting ingress and egress to and from the interior of said vehicle, comprising;

(a) locking and latching means on said vehicle for normally locking and latching said door, (b) means on said door located interiorily of said vehicle for normally actuating said locking and latching means, (c) auxiliary means affixed to said vehicle for sequentially actuating said locking and latching means first from a locked position to an unlocked position and then from a latched position to an unlatched position, (d) means for generating a control signal remote from and exteriorly of said vehicle, (e) control means fixed to said vehicle for actuating said auxiliary means in response to said control signal, (f) opening means fixed to only one of said door and body of said vehicle actuable to exert a force on said door sufficient to at least partially open the same in response to a signal from said auxiliary means to thereby permit rapid entry to the interior of said vehicle, (g) said means for generating a control signal comprises a transmitter, (h) said control means comprises a receiver, (i) said control means further comprises a first switching device actuated by said receiver, (j) said auxiliary means comprises a solenoid responsive to said first switching device and located adjacent said locking and latching means for imparting a force thereto in a direction of unlocking and unlatching said vehicle door, (k) said solenoid includes a plunger for imparting said force, (l) a second switching device adjacent one end of said plunger actuable at the end of the plunger's stroke, and (m) said opening means is actuable in response to said second switching device.

13. The apparatus according to claim 12, wherein;

(o) said opening means comprises a solenoid responsive to said second switching device having a plunger for imparting a relative force on said door sufficient to partially open the same.

14. The apparatus according to claim 13, wherein;

(p) said first switching device includes a differential relay and a switch actuable thereby to remain in either the open or closed position, and (q) a third switching device adjacent one end of said last mentioned plunger actuable at the end of the stroke thereof to energize said differential relay to move said switch from its closed to its open position and thereby open the circuit to all of said solenoids.

15. The apparatus according to claim 14, wherein;

(r) said first switching device further includes a switch responsive to said receiver for energizing one core of said differential relay to close said first mentioned switch.

* * * * *